United States Patent [19]

Webster

[11] Patent Number: 4,844,457

[45] Date of Patent: Jul. 4, 1989

[54] GAMES TABLES

[76] Inventor: Terrence L. Webster, 3 Bronnies Way, Diep River, Cape Town, South Africa

[21] Appl. No.: 149,433

[22] Filed: Jan. 29, 1988

[30] Foreign Application Priority Data

Jan. 29, 1987 [ZA] South Africa ..... 87/0663

[51] Int. Cl.[4] ..... A63D 15/00

[52] U.S. Cl. ..... 273/3 A; 273/123 R

[58] Field of Search ..... 273/2.3 A, 3 R, 6, 8, 273/123 R, 128 A, 87 B, 176 E; D21/10, 14, 20, 21, 7, 8, 9, 16, 17, 34, 36

[56] References Cited

U.S. PATENT DOCUMENTS

| | | | |
|---|---|---|---|
| D. 83,497 | 3/1931 | Carter | D21/11 |
| 364,999 | 6/1887 | Gantner et al. | 273/3 A |
| 3,170,694 | 2/1965 | Dolce | 273/123 R X |
| 3,360,265 | 12/1967 | Yabroudy | 273/3 R X |
| 3,554,108 | 12/1970 | Bali | 273/3 A X |
| 3,554,553 | 1/1971 | Hayashi | 273/128 A X |
| 3,647,215 | 3/1972 | Sterlicchi et al. | 273/123 R |
| 3,958,804 | 5/1976 | Godfrey | 273/3 A X |
| 3,985,355 | 10/1976 | Shoemaker | 273/3 A |
| 4,531,739 | 7/1985 | Dunn Jr. et al. | 273/127 C |

FOREIGN PATENT DOCUMENTS

| | | | |
|---|---|---|---|
| 63517 | 1/1912 | Austria | 273/3 A |
| 406918 | 3/1934 | United Kingdom . | |
| 2166962 | 5/1986 | United Kingdom . | |

*Primary Examiner*—Robert E. Garrett
*Assistant Examiner*—Joseph M. Pitko
*Attorney, Agent, or Firm*—Willian Brinks Olds Hofer Gilson & Lione

[57] ABSTRACT

A game table is disclosed which comprises a playing surface surrounded by a cushion. The shape of the table is such that certain cushions cannot be joined to other cushions by a line which crosses the playing surface and which is straight. The configuration is such that there are areas of the playing surface which can only be joined by a line extending across the playing surface if the line is curved. Thus a ball cannot roll between these areas without rebounding-off a cushion unless it is struck skew to impart spin to it.

2 Claims, 1 Drawing Sheet

GAMES TABLES

SUMMARY OF THE INVENTION

This invention relates to games tables.

According to one aspect of the present invention there is provided a game table on which a ball game is played, the table comprising a playing surface and a cushion surrounding the playing surface, at least two sections of said cushion being arranged so that they cannot be joined to one another by a line which is straight when viewed from above and which extends across said playing surface.

Said playing surface can include at least one hump or at least one depression. The playing surface preferably includes at least one hump and at least one depression, and desirably a plurality of humps and depressions.

In a preferred form the table is L-shaped, and in another form three limbs of the table are disposed at 120 degrees.

BRIEF DESCRIPTION OF THE DRAWINGS

For a better understanding of the present invention, and to show how the same may be carried into effect, reference will now be made, by way of example, to the accompanying drawings in which.

Figure 1:
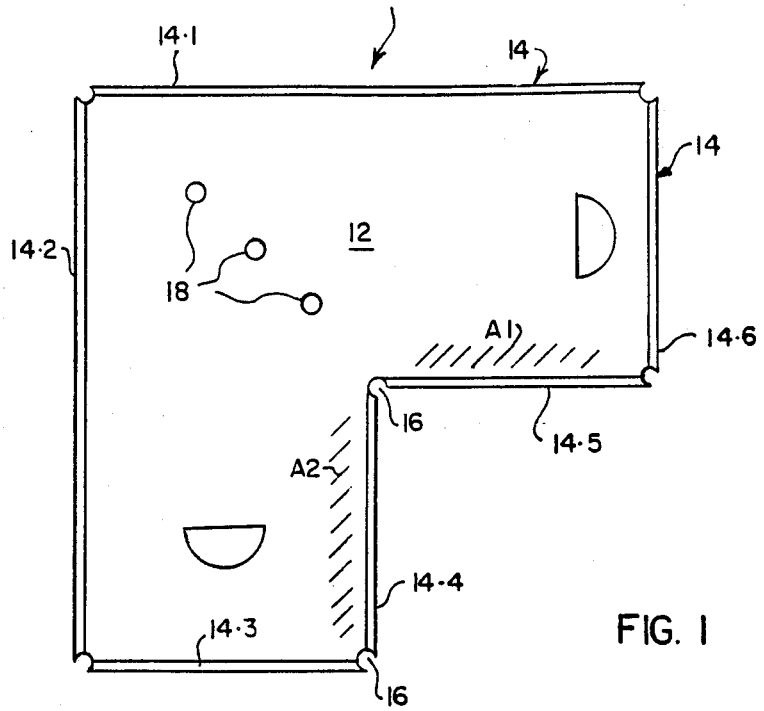
FIG. 1 is a top plan view of a first games table.

The table 10 of FIG. 1 comprises a playing surface 12 surrounded by a cushion 14. The surface 12 is constituted by a wooden base covered with cloth e.g. baize such as is conventionally used on snooker tables. The cushion 14 comprises a raised wooden rim to the inner face of which a strip of resilient material, e.g. rubber is fixed. The baize extends upwardly to cover the resilient strip and is secured in any suitable manner to the wooden rim. Pockets are diagrammatically shown at 16, these being constituted by gaps in the cushion 14 and including net sacks for catching the balls which leave the playing surface through a pocket.

As will be clearly seen from FIG. 1, the table is L-shaped thereby giving rise to two long cushion sections 14.1 and 14.2 and four short cushion sections 14.3 to 14.6. The cushion sections 14.1, 14.3 and 14.5 are all parallel to one another and at right angles to the cushion sections 14.2, 14.4. and 14.6. There is a pocket 16 at each of the places on the table where two cushion sections meet at right angles. The cushion section 14.4 is the same length as the cushion section 14.5 but can, if desired be of a different length eg half as long.

It will be noted that, unlike the cushion sections of a rectangular table, the cushion sections of the table of FIG. 1 cannot all be joined to one another by straight lines extending across the playing surface 12. Thus parts of the cushion section 14.3 cannot be joined by a straight line to parts of the cushion section 14.1 or to any parts of the cushion sections 14.5 and 14.6. There are consequently areas of the table which cannot be reached from other areas of the table by a ball struck by a cue and travelling in a straight line. Thus the area designated A1 cannot be reached from the area designated A2 without the ball following a curve line or without striking at least the cushion section 14.1, and probably without striking the cushion sections 14.1 and 14.2 during its travel.

In view of the above, it may be seen that the table of FIG. 1 may be described as a games table on which a ball game is played, the table comprising a playing surface and a cushion surrounding the playing surface, the playing surface being L-shaped and the cushion comprising first and second sections which are of the same length as one another and meet at a right angle, third and fourth sections which also meet at a right angle, which are of the same length as one another but which are shorter than the first and second sections, the first and third sections being parallel to one another and spaced apart and the second and fourth sections being parallel to one another and spaced apart, fifth and sixth sections which are at right angles to one another, the fifth section joining the ends of the first and third sections and the sixth section joining the ends of the second and fourth sections, and pockets into which, during the game, the balls fall, there being pockets at intersections between cushion sections.

The playing surface 12 can include at least one hump or at least one depression, and preferably a plurality of humps and depressions spread over its area. Desirably such humps and depressions, when viewed in section, are non-symmetrical. The humps and depressions themselves ensure that a rolling ball acts in an unpredictable fashion, and making the humps and depressions non-symmetrical causes a rolling ball to act in an even more unpredictable fashion. To achieve this configuration the base can be of fiberglass instead of wood.

Figure 2:
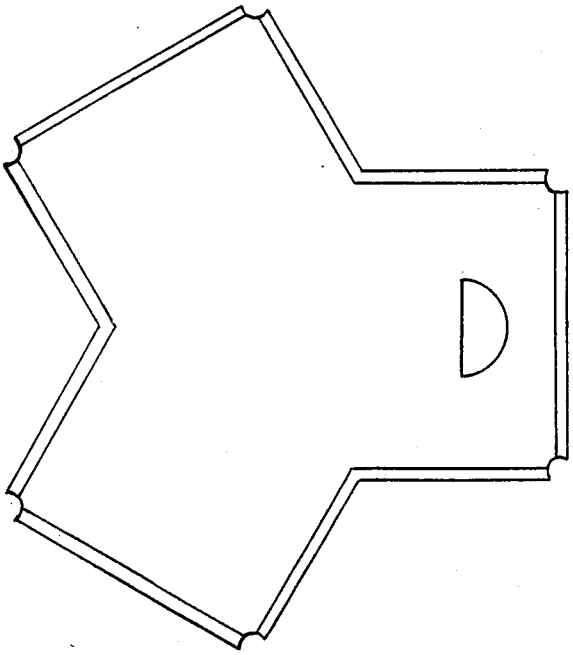
FIG. 2 is a top plan view of a second games table.

The table of FIG. 2 differs from the table of FIG. 1 in that it has three limbs which are arranged at 120 degrees with respect to one another. All the cushion sections are straight and there are pockets where the cushion sections forming the ends of the limbs meet with the cushion sections forming the sides of the limbs. The table of FIG. 2 also has areas which cannot be reached from other areas by a ball struck by a cue and travelling in a straight line.

The table of FIG. 2 is a games table on which a ball game is played, the table comprising a playing surface and a cushion surrounding the playing surface, the cushion comprising first and second sections which are parallel to one another, third and fourth sections which are parallel to one another, and fifth and sixth sections which are parallel to one another, one end of said first section being joined to one end of the second section by a seventh section which is at right angles to the first and second sections, one end of the third section being joined to one end of the fourth section by an eighth section which is at right angles to the third and fourth sections, and a ninth section which is at right angles to the fifth and sixth sections and which joins one end of the fifth section to one end of the sixth section, the second and third sections intersecting one another at an included angle of 120 degrees, the fourth and fifth sections intersecting one another at an included angle of 120 degrees, and the first and sixth sections intersecting one another at an angle of 120 degrees thereby to provide a table which has three limbs lying at angles of 120 degrees with respect to one another, there being pockets where the seventh, eighth and ninth sections intersect the first to sixth sections.

If desired the sacks over the pockets can be omitted and the pockets can form the entrances to pathways which themselves lead down to a coin-operated ball storage area. Thus the balls pocketed cannot be retrieved until the coin-operated mechanism is freed by insertion of a coin to start a new game.

To add further interest to the game, a resilient bumper, or resilient bumpers, can be provided within the area bounded by the cushion 14. The bumper, or each bumper, can be loose and can comprise a heavy core eg of lead covered with rubber. Such a bumper is placed on the table. Alternatively the bumper can be secured, either permanently or releasably, to the table. Such a bumper can be entirely of resilient material or can comprise a metal core covered with rubber. The spindle can protrude below the rubber covering and be screwed into a socket provided therefor in the table. A row of three bumpers is shown at 18 in FIG. 1.

I claim:

1. A games table on which a ball game is played, the table comprising a playing surface and a cushion surrounding the playing surface, the playing surface being L-shaped and the cushion comprising first and second sections which are of the same length as one another and meet at a right angle, third and fourth sections which also meet at a right angle, which are of the same length as one another but which are shorter than the first and second sections, the first and third sections being parallel to one another and spaced apart and the second and fourth sections being parallel to one another and spaced apart, fifth and sixth sections which are at right angles to one another, the fifth section joining the ends of the first and third sections and the sixth section joining the ends of the second and fourth sections, and pockets into which, during the game, the balls fall, there being pockets at intersections between cushion sections.

2. A games table on which a ball game is played, the table comprising a playing surface and a cushion surrounding the playing surface, the cushion comprising first and second sections which are parallel to one another, third and fourth sections which are parallel to one another, and fifth and sixth sections which are parallel to one another, one end of said first section being joined to one end of the second section by a seventh section which is at right angles to the first and second sections, one end of the third section being joined to one end of the fourth section by an eighth section which is at right angles to the third and fourth sections, and a ninth section which is at right angles to the fifth and sixth sections and which joins one end of the fifth section to one end of the sixth section, the second and third sections intersecting one another at an included angle of 120 degrees, the fourth and fifth sections intersecting one another at an included angle of 120 degrees, and the first and sixth sections intersecting one another at an angle of 120 degrees thereby to provide a table which has three limbs lying at angles of 120 degrees with respect to one another, there being pockets where the seventh, eighth and ninth sections intersect the first to sixth sections.

* * * * *